US010036976B2

(12) United States Patent
Nagatomo et al.

(10) Patent No.: US 10,036,976 B2
(45) Date of Patent: Jul. 31, 2018

(54) DEVELOPING DEVICE, AND IMAGE FORMING APPARATUS AND PROCESS UNIT INCORPORATING SAME

(71) Applicants: Yuji Nagatomo, Kanagawa (JP); Tetsumaru Fujita, Kanagawa (JP); Masato Tsuji, Kanagawa (JP); Yutaro Kaku, Tokyo (JP)

(72) Inventors: Yuji Nagatomo, Kanagawa (JP); Tetsumaru Fujita, Kanagawa (JP); Masato Tsuji, Kanagawa (JP); Yutaro Kaku, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/367,514

(22) Filed: Dec. 2, 2016

(65) Prior Publication Data

US 2017/0176886 A1 Jun. 22, 2017

(30) Foreign Application Priority Data

Dec. 17, 2015 (JP) ..... 2015-246318
Nov. 2, 2016 (JP) ..... 2016-215216

(51) Int. Cl.
*G03G 15/08* (2006.01)

(52) U.S. Cl.
CPC ..... *G03G 15/0812* (2013.01)

(58) Field of Classification Search
CPC ..... G03G 15/0812; G03G 15/08; G03G 9/08; G03G 9/0821; G03G 9/09716
See application file for complete search history.

(56) References Cited

U.S. PATENT DOCUMENTS 4,284,701 A * 8/1981 Abbott ..... G03G 9/0819 430/110.4
2008/0131174 A1 6/2008 Inoue et al.
(Continued)

FOREIGN PATENT DOCUMENTS

JP 8-069173 3/1996
JP 11-167278 6/1999
(Continued)

OTHER PUBLICATIONS

U.S. Appl. No. 15/346,018, filed Nov. 8, 2016.

*Primary Examiner* — Clayton E Laballe
*Assistant Examiner* — Ruifeng Pu
(74) *Attorney, Agent, or Firm* — Harness, Dickey & Pierce, P.L.C.

(57) ABSTRACT

A developing device includes a developer bearer facing a latent image bearer, to rotate and supply developer to the latent image bearer, and a developer regulator to regulate an amount of the developer on a surface of the developer bearer. The developer regulator is in contact with the surface of the developer bearer. In the developing device, a ratio of a ten-point mean roughness of the developer regulator to a volume average particle diameter of the developer is not greater than 3.5%. The ratio is defined as $$Rzjis/Dv \times 100,$$

where Rzjis represents the ten-point mean roughness measured in a nip-adjacent portion of a face of the developer regulator opposing the developer bearer, and Dv represents the volume average particle diameter of the developer. The nip-adjacent portion is adjacent to and downstream a downstream end of a regulation nip in a rotation direction of the developer bearer.

15 Claims, 2 Drawing Sheets

(56) References Cited

U.S. PATENT DOCUMENTS

| | | | | |
|---|---|---|---|---|
| 2008/0247791 | A1* | 10/2008 | Iwata | G03G 15/0812 399/350 |
| 2010/0215410 | A1* | 8/2010 | Ito | G03G 15/0812 399/284 |
| 2011/0188896 | A1 | 8/2011 | Sakaya et al. | |
| 2012/0045254 | A1* | 2/2012 | Inoue | G03G 15/0812 399/284 |
| 2013/0142530 | A1 | 6/2013 | Yamamoto et al. | |
| 2013/0164044 | A1* | 6/2013 | Hasegawa | G03G 15/0812 399/274 |
| 2013/0236217 | A1 | 9/2013 | Nagatomo et al. | |
| 2014/0161471 | A1 | 6/2014 | Matsuno et al. | |
| 2014/0270861 | A1 | 9/2014 | Fujita et al. | |
| 2016/0252869 | A1* | 9/2016 | Hagimoto | G03G 21/0017 399/350 |

FOREIGN PATENT DOCUMENTS

| | | |
|---|---|---|
| JP | 2001-350285 | 12/2001 |
| JP | 2004-126005 | 4/2004 |
| JP | 2007-232893 | 9/2007 |
| JP | 2007-264240 | 10/2007 |
| JP | 2007-293106 | 11/2007 |
| JP | 2008-139552 | 6/2008 |
| JP | 2014-178554 | 9/2014 |

* cited by examiner

DEVELOPING DEVICE, AND IMAGE FORMING APPARATUS AND PROCESS UNIT INCORPORATING SAME

CROSS-REFERENCE TO RELATED APPLICATIONS

This patent application is based on and claims priority pursuant to 35 U.S.C. § 119(a) to Japanese Patent Application Nos. 2015-246318, filed on Dec. 17, 2015, and 2016-215216, filed on Nov. 2, 2016, in the Japan Patent Office, the entire disclosure of each of which is hereby incorporated by reference herein.

BACKGROUND

Technical Field

Embodiments of the present invention generally relate to a developing device, a process unit including the developing device, and an image forming apparatus including the developing device.

Description of the Related Art

In image forming apparatuses employing electrophotography, such as copiers, printers, and multifunction peripherals (MFPs) or multifunction machines, developing devices employing one-component development are used. In one-component development, toner is used as developer and carrier is not used.

Generally, developing devices employing one-component development includes a regulation blade to regulate developer, disposed in contact with the surface of a developing roller serving as a developer bearer. As the developing roller rotates, toner borne on the developing roller passes a regulation nip, where the regulation blade contacts the developing roller, and the thickness of the toner thereon is regulated. Subsequently, the toner is supplied to an image bearer, such a photoconductor.

SUMMARY

An embodiment of the present invention provides a developing device that includes a developer bearer disposed facing a latent image bearer, to rotate to supply developer to the latent image bearer, and a developer regulator to regulate an amount of the developer borne on a surface of the developer bearer. The developer regulator is disposed in contact with the surface of the developer bearer. In the developing device, a ratio of a ten-point mean roughness of the developer regulator to a volume average particle diameter of the developer is not greater than 3.5%. The ratio is defined as $$Rzjis/Dv \times 100,$$

where Rzjis represents the ten-point mean roughness measured in a nip-adjacent portion of an opposing face of the developer regulator opposing the developer bearer, and Dv represents the volume average particle diameter of the developer. The nip-adjacent portion is adjacent to and downstream from a downstream end of a regulation nip, where the developer regulator contacts the developer bearer, in a rotation direction of the developer bearer.

In another embodiment, a process unit to be removably mounted in an image forming apparatus includes the latent image bearer and the developing device described above.

In yet another embodiment, an image forming apparatus includes the process unit described above.

In yet another embodiment, an image forming apparatus includes the latent image bearer and the developing device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
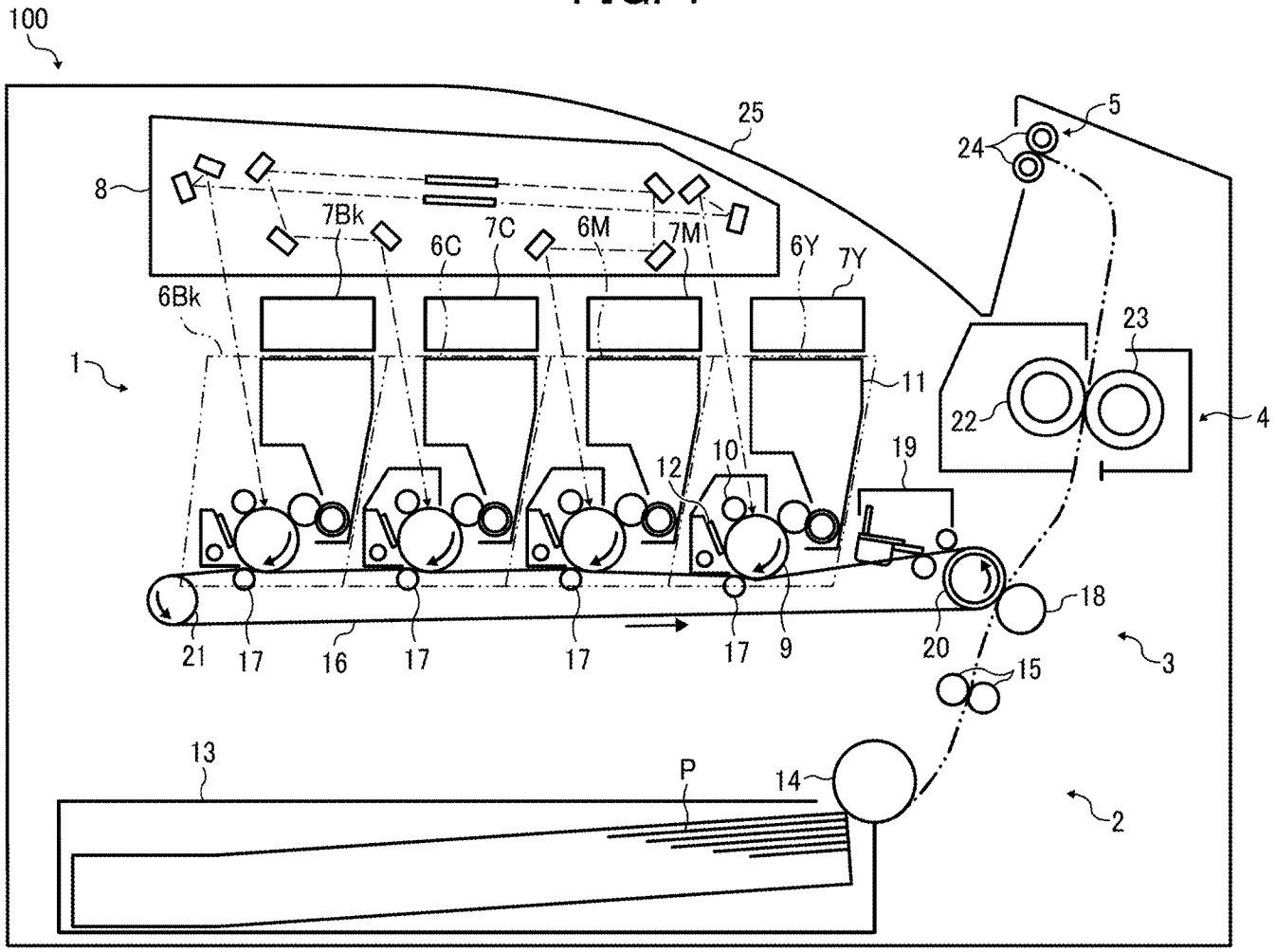
FIG. 1 is a schematic view of an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of the present invention is described. As used herein, the singular forms "a", "an", and "the" are intended to include the plural forms as well, unless the context clearly indicates otherwise.

It is to be noted that the suffixes Y, M, C, and Bk attached to each reference numeral indicate only that components indicated thereby are used for forming yellow, magenta, cyan, and black images, respectively, and hereinafter may be omitted when color discrimination is not necessary.

Initially, descriptions are given below of a basic structure of an image forming apparatus according to an embodiment, using a color printer illustrated in FIG. 1, as an example. However, image forming apparatuses to which one or more aspects of this disclosure are applied are not limited thereto but include monochrome printers, printers of other types, copiers, facsimile machines, and multifunction peripherals having these capabilities.

An image forming apparatus 100 illustrated in FIG. 1 includes a tandem image forming section 1, a sheet feeder 2, a transfer section 3, a fixing device 4, and a sheet ejection section 5.

The tandem image forming section 1 includes four process units 6 (6Y, 6M, 6C, and 6Bk) serving as image forming units, four toner cartridges 7 (7Y, 7M, 7C, and 7Bk) serving as developer containers, and an exposure device 8 serving as a latent image forming device. The process units 6 and the toner cartridges 7 are removably mounted in the body of the image forming apparatus 100. The process units 6Y, 6C, 6M, and 6Bk and the toner cartridges 7Y, 7M, 7C, and 7Bk respectively contain yellow (Y), magenta (M), cyan (C), and black (Bk) toners corresponding to decomposed color components of full-color images and are similar in configuration except the color of toner contained therein. Specifically, the process unit 6 includes a photoconductor drum 9 serving as an image bearer, a charging roller 10 serving as a charger, a developing device 11, and a cleaning device 12. In FIG. 1, the photoconductor drum 9, the charging roller 10, the developing device 11, and the cleaning device 12 of only the process unit 6Y for yellow are given reference numerals, and reference numerals of those of other process units 6M, 6C, and 6Bk are omitted for simplicity.

The sheet feeder 2 includes a sheet tray 13 for containing sheets of recording media (i.e., recording sheets), a sheet feeding rollers 14, and a timing roller pair 15 serving as a recording medium conveyor. The recording media include, in addition to plain paper, heavy paper, thin paper such as tracing paper, post cards, coated paper (including art paper), overhead projector (OHP) sheets or film, and special purpose sheets.

The transfer section 3 serves as a transfer device and includes an intermediate transfer belt 16 (i.e., an intermediate transfer member), four primary transfer rollers 17, a secondary transfer roller 18, and a belt cleaner 19. The intermediate transfer member can be belt-shaped or drum-shaped. The intermediate transfer belt 16 is an endless belt and entrained around the primary transfer rollers 17 and support rollers including a driving roller 20 and a driven roller 21. Each primary transfer roller 17 is disposed in contact with the inner face of the intermediate transfer belt 16, at a position opposite the corresponding photoconductor drum 9. The secondary transfer roller 18 is disposed in contact with the outer face of the intermediate transfer belt 16, at a position opposite the driving roller 20.

The fixing device 4 includes a pair of rollers, one of which is a fixing roller 22 heated by a heater such as a halogen heater. The other roller is a pressure roller 23 pressed against the fixing roller 22.

The sheet ejection section 5 includes an ejection roller pair 24 and an output tray 25, on which output sheets are stored.

Referring to FIG. 1, image formation by the color printer according to the present embodiment is described below. When image formation is started, the photoconductor drum 9 starts rotating, and the charging roller 10 uniformly charges the surface of the photoconductor drum 9 to a high potential. Subsequently, according to either image data of a document scanned by a scanner or print data instructed from a terminal, the exposure device 8 exposes the surface of the photoconductor drum 9. Thus, the potential of the exposed portion decreases, and an electrostatic latent image is formed. The developing device 11 supplies toner to the electrostatic latent image, thereby developing the latent image into a toner image.

Reaching the positions (i.e., primary transfer nips) opposing the primary transfer rollers 17, respectively, the toner images are transferred from the photoconductor drums 9 and superimposed one on another on the intermediate transfer belt 16 that is rotating. Thus, a multicolor (full-color) toner image is formed on the intermediate transfer belt 16. The cleaning devices 12 remove the toner remaining, untransferred, on the respective photoconductor drums 9.

Additionally, when image formation is started, the sheet feeding rollers 14 rotates, thereby transporting a recording sheet P from the sheet tray 13. Then, the timing roller pair 15 stops the recording sheet P and forwards the recording sheet P to a position (i.e., a secondary transfer nip) opposing the secondary transfer roller 18, timed to coincide with the toner image on the intermediate transfer belt 16. Then, the toner image is transferred from the intermediate transfer belt 16 onto the recording sheet P. The belt cleaner 19 remove toner remaining on the intermediate transfer belt 16, untransferred onto the recording sheet P.

Then, the recording sheet P is transported to the fixing device 4. While the recording sheet P passes the fixing nip between the fixing roller 22 and the pressure roller 23, the toner image is fixed thereon with heat and pressure. The ejection roller pair 24 ejects the recording sheet P onto the output tray 25, and a sequence of image forming operation completes.

Although the description above concerns multicolor image formation, alternatively, the image forming apparatus 100 can form single-color images, bicolor images, or three-color images using one, two, or three of the four process units 6.

Next, descriptions are given below of structures of the developing device and the toner cartridge, with reference to FIG. 2. Since the developing devices 11 and the toner cartridges 7 (7Y, 7M, 7C, and 7Bk) are similar in structure except the color of toner stored therein, the developing device 11 and the toner cartridge 7 of one of four colors are described as representatives to simply the description.

Figure 2:
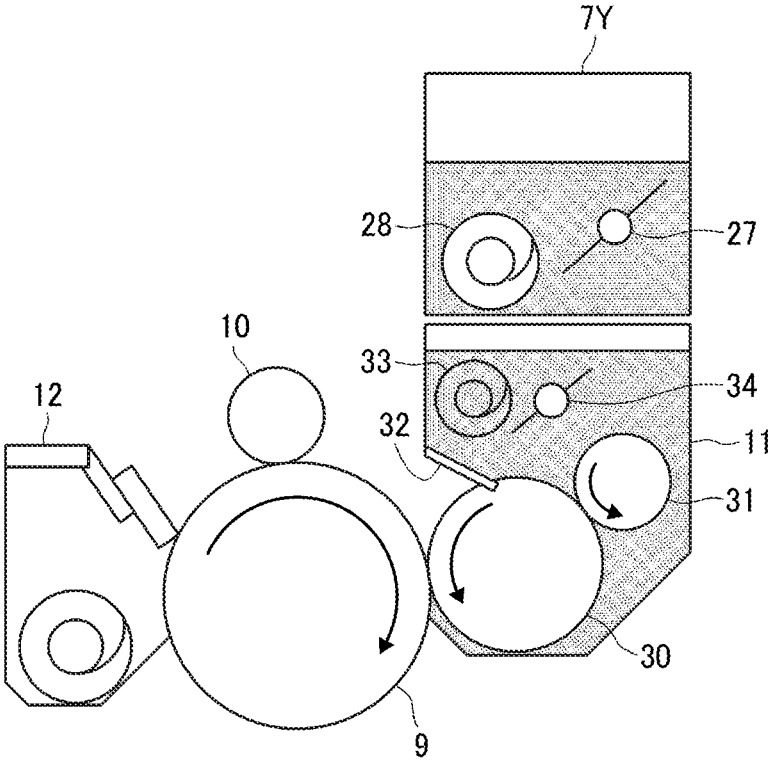
FIG. 2 is a schematic end-on axial view of a developing device and a toner cartridge according to an embodiment.

As illustrated in FIG. 2, the toner cartridge 7Y contains a paddle 27, serving as an agitator or stirrer, and a conveying screw 28, serving as a conveyor. The paddle 27, which rotates, stirs the toner inside the toner cartridge 7Y to maintain fluidity or flowability of the toner. As the conveying screw 28 rotates, the toner in the toner cartridge 7Y is transported and supplied through a supply opening to the developing device 11.

The developing device 11 illustrated in FIG. 2 is of nonmagnetic one-component development and uses nonmagnetic toner as the developer without using carrier. The developing device 11 according to the present embodiment includes a developing roller 30 serving as a developer bearer, a supply roller 31 to supply toner to the developing roller 30, a regulation blade 32 serving as a developer regulator, a conveying screw 33 for toner conveyance, and an agitator 34 to stir toner. However, embodiments according to the present disclosure are not limited to the structure illustrated in FIG. 2 but include other developing devices as long as the developing device employs nonmagnetic one-component development.

For example, the developing roller 30 includes a metal shaft; an elastic body overlying the metal shaft, and a resin coat layer made of acrylic resin, urethane resin, or the like. Examples of elastic body include urethane rubber, silicone rubber, nitrile butadiene rubber (NBR), and the like. The resin coal layer preferably has a thickness of from 1 μm to 30 μm. Instead of providing the resin coat layer, the developing roller 30 can be subjected to surface treatment such as ultraviolet (UV) irradiation.

Generally, the supply roller 31 includes a metal shaft and a formed material overlying the metal shaft. Examples of the formed material include foamed urethane, formed silicone, and foamed ethylene-propylene-diene monomer (EPDM) rubber. The formed material is preferably subjected to conductive treatment. The supply roller 31 is disposed in contact with the surface (outer face) of the developing roller 30.

The regulation blade 32 is made of a flexible blade, such as a thin metal plate having a thickness of about 0.1 mm. An example of the metal is Special Use stainless (SUS) Steel according to Japan Industrial Standard (JIS). A first end of the regulation blade 32 is secured, via a holder, to the body (i.e., a casing) of the developing device 11. Alternatively, welding, press fit, screwing, or the like can be used to secure the regulation blade 32 to the holder. A second end (opposite the first end secured to the holder) of the regulation blade 32 is a free end (not secured). A portion adjacent to the second end (i.e., on a free end side) is disposed to contact the surface of the developing roller 30. In the structure illustrated in FIG. 2, the regulation blade 32 is in the posture counter to the rotation of the developing roller 30. That is, the free end thereof is oriented in the direction opposite the rotation direction of the developing roller 30. A free length (from the position secured to the holder to the free end) of the regulation blade 32 is 11 mm, for example.

Figure 3:
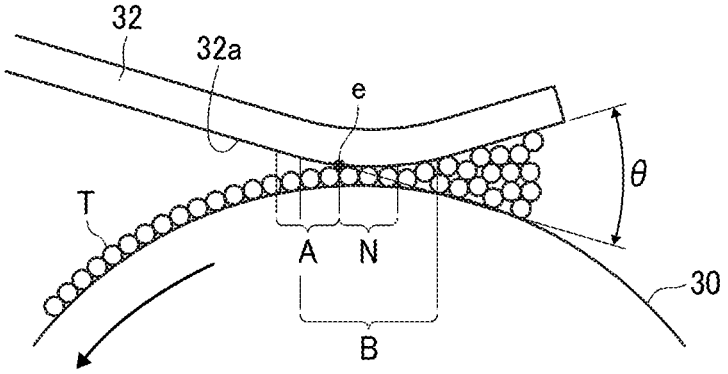
FIG. 3 is an enlarged end-on axial view illustrating a position where a regulation blade contacts a developing roller, according to an embodiment.

As illustrated in the enlarged view of FIG. 3, on the free-end side, the regulation blade 32 includes a bend B disposed at, for example, 0.5 mm from the free end. The bend B has a bent angle θ greater than 0 degree and not greater than 90 degrees. The regulation blade 32 is disposed so that the bend B is in contact with or is closest to the surface of the developing roller 30 to define a regulation nip N to regulate the amount of developer borne on the developing roller 30. The contact pressure of the regulation blade 32 against the developing roller 30 is set to 40 N/m, for example.

Operation of the developing device is described below. When image formation is started, the developing roller 30 and the supply roller 31 start rotating in the directions indicated by respective arrows. As the developing roller 30 and the supply roller 31 rotate, in the contact portion therebetween (i.e., a supply nip), the supply roller 31 supplies toner to the developing roller 30. As the developing roller 30 rotates, toner T (see FIG. 3) borne on the developing roller 30 is transported to the regulation nip N, where the regulation blade 32 contacts the developing roller 30. While the toner T passes the regulation nip N, the thickness of the toner T is regulated to a uniform thickness. Subsequently, the toner is transported to the position facing the photoconductor drum 9 (i.e., a developing range), and the toner electrostatically moves to the electrostatic latent image on the photoconductor drum 9. Thus, a toner image is formed. The toner that is not transferred to the photoconductor drum 9 but remains on the developing roller 30 is transported to the supply nip and scraped off from the developing roller 30 by the supply roller 31.

In such a developing device, since the regulation blade contacts the developing roller via the toner, there is a risk that toner adhering to the regulation blade causes a white streak in output images. The toner is caught by the regulation blade, accumulates on the regulation blade. Heat of friction melts the toner, and the toner solidifies on the regulation blade. Further adhesion starts from the solidified toner, and the solidified toner grows in the regulation nip as solidification is repeated. When the toner adhesion grows to a coagulation of about several tens to several hundreds micro meters in size, it is possible that the coagulation hinders the toner on the developing roller from moving together with the rotating developing roller. Then, the coagulation creates a streak of void (toner absent area) in images (i.e., white streak images). Conceivably, inhibiting the toner adhesion that becomes the origin of repeated toner adhesion is effective to suppress the growth of toner adhesion.

In view of the foregoing, the inventors have studied the mechanism of toner adhesion and found that the origin of toner adhesion is adjacent to a downstream end e (illustrated in FIG. 3) of the regulation nip N in the rotation direction of the developing roller 30. That is, the toner adhesion starts at a position at which the regulation blade 32 is separated from the developing roller 30. The toner is caught by the regulation blade 32 because the surface of the regulation blade 32 has micro projections and recesses (unevenness roughness). For example, in a case of a regulation blade made of a thin, steel stainless plate, micro projections and recesses are created while the thin plate is molded by rolling, and the toner is caught by micro projections or recesses, resulting in toner adhesion. Additionally, small-diameter toner is more likely to be caught by the surface unevenness than large-diameter toner.

According to the above-described findings, the toner adhesion to the regulation blade 32 can be inhibited by smoothing the surface of the regulation blade 32 in a portion where toner adhesion starts, that is, adjacent to the downstream end e of the regulation nip N in the rotation direction of the developing roller. In view of the foregoing, in the present embodiment, an area A (illustrated in FIG. 3) of the regulation blade 32 is polished with wrapping film or the like to make the surface smooth, thereby reducing the surface roughness. The area A is located on an opposing face 32*a* of the regulation blade 32 opposing the developing roller 30 and extends for 2 mm downstream starting from the downstream end e of the regulation nip N in the rotation direction of the developing roller 30.

An example of the wrapping film is made by applying a polishing agent to a base such as polyester or polyethylene terephthalate (PET). Examples of the polishing agent include particles of aluminum oxide, chromium oxide, silicon oxide, diamond, and the like. The range to be polished is set to the area A extending for 2 mm to the downstream side from the downstream end e of the regulation nip N from the following reason. As the regulation blade 32 wears with elapse of time, the area of the regulation nip tends to extend, and the downstream end e of the regulation nip N tends to shift to the downstream side. Accordingly, a margin is added to the range to be smoothed considering the operational life of the product. Alternatively, blasting, chemical polishing, or the like is applicable to smooth the surface of the regulation blade 32. If the thin plate is smooth, such polishing is not necessary.

The inventors performed Experiment 1 to ascertain the effect to inhibit toner adhesion. In Experiment 1, a plurality of sample regulation blades different in surface roughness and bend angle were used. Specifically, to evaluate the effect to inhibit toner adhesion, output images were checked for a while streak. Additionally, image quality (resolution) was rated using toners different in softening point and volume average particle diameter.

Test conditions are described in further detail below. The regulation blades and the toners used in the experiment have the following characteristics.

(Test Sample 1)

Regulation blade: The regulation blade is made of stainless steel, SUS304. The bend B is located at 0.5 mm from the free end of the regulation blade, and the bend angle θ is 20 degrees. The opposing face 32*a* of the regulation blade opposing the developing roller 30 includes a polished area polished with wrapping film, and the polished area extends to the downstream side (to the secured side) for 2 mm from a position equivalent to the downstream end e of the regulation nip N in the rotation direction of the developing roller 30. In the regulation blade of Test sample 1, ten-point mean roughness was measured in a range (within the polished area) extending to the downstream side for 0.8 mm from the downstream end of the regulation nip in the rotation direction of the developing roller 30. The ten-point mean roughness was 0.17 μm.

Toner: Toner having a softening point of 110° C. and a volume average particle diameter of 6.5 μm was used.

It is to be noted that the downstream end of the bend B can coincide with downstream end e of the regulation nip N.

(Test Sample 2)

Regulation blade: The regulation blade of Test sample 2 is similar to that of Test sample 1 except that the bend angle is 40 degrees. The ten-point mean roughness, measured in the range specified in Test sample 1, was 0.17 μm.

Toner: The toner is similar to that of Test sample 1.

(Test Sample 3)

Regulation blade: The regulation blade of Test sample 3 is similar to that of Test sample 1 except that the bend angle is 50 degrees. The ten-point mean roughness, measured in the range specified in Test sample 1, was 0.18 μm.

Toner: The toner is similar to that of Test sample 1.

(Test Sample 4)

Regulation blade: The regulation blade of Test sample 4 is similar to that of Test sample 1 except that the bend angle is 90 degrees. The ten-point mean roughness, measured in the range specified in Test sample 1, was 0.19 μm.

Toner: The toner is similar to that of Test sample 1.

(Test Sample 5)

Regulation blade: The regulation blade is similar to that of Test sample 1 except that the regulation blade is not polished with wrapping film. The ten-point mean roughness, measured in the range specified in Test sample 1, was 0.25 μm. Toner Toner having a softening point of 112° C. and a volume average particle diameter of 8.0 μm was used.

(Test Sample 6)

Regulation blade: The regulation blade is similar to that of Test sample 1 except that the regulation blade is not polished with wrapping film. The ten-point mean roughness, measured in the range specified in Test sample 1, was 0.25 μm.

Toner: The toner is similar to that of Test sample 1.

(Test Sample 7)

Regulation blade: The regulation blade of Test sample 7 is similar to that of Test sample 1. The ten-point mean roughness, measured in the range specified in Test sample 1, was 0.17 μm. Toner Toner having a softening point of 112° C. and a volume average particle diameter of 8.0 μm was used.

(Measurement of Ten-Point Mean Roughness of the Regulation Blade)

The ten-point mean roughness was measured according to JIS-2001 of Japanese Industrial Standards, using SURFCOM 1400D manufactured by Tokyo Seimitsu Co., Ltd., under conditions of a scanning speed of 0.15 mm/s, a long-wavelength cutoff λc of 0.8 mm, a short-wavelength cutoff λs of 2.67 μm. More specifically, at three positions (5 cm from the both ends and a center position) in the longitudinal direction (corresponding to the axial direction of the developing roller) of the regulation blade, a sensing pin scans the regulation blade in the short side direction (corresponding to the arc-shaped circumference of the developing roller) of the regulation blade. Then, the roughness was measured in the range extending downstream for 0.8 mm from the downstream end of the bend B, and the mean value of the measurement values at the three positions was calculated.

(Measurement of Toner Softening Point)

Using a flow tester (CFT-500 from Shimadzu Corp.), 1.0 gram of the sample was measured. Using a die of 1.0 mm in height and 0.5 mm in inner diameter, the sample was heated at a temperature rising speed of 3.0° C./min (with a preheating time of 120 s) while applying a load of 30 kilograms, and the sample was measured in a measurement temperature range of from 40° C. to 140° C. The temperature at which the half of the sample flowed out was used as the softening point.

(Measurement of Volume Average Particle Diameter of Toner)

The volume average particle diameter of toner can be measured by a coulter counter method. The particle size distribution of toner can be measured by a Coulter counter TA-II or Coulter Multisizer II or III from Beckman Coulter, Inc. Initially, 0.1 ml to 5 ml of surfactant, preferably alkylbenzene sulfonate, is added as dispersant to 100 ml to 150 ml of electrolyte. The electrolyte solution used here is, for example, 1 percent NaCl solution, produced using primary sodium chloride. ISOTON-II manufactured by Beckman Coulter, Inc. is available as a ready-made electrolyte solution. Then, 2 mg to 20 mg of the sample (in solids) is added to the electrolyte solution. Then, the electrolyte solution in which toner is suspended (i.e., a sample dispersion liquid) is dispersed by an ultrasonic disperser for about 1 to 3 minutes. The volume and the number of the toner particles are measured by either of the above measurement instruments with an aperture of 100 μm, and the volume distribution and number distribution thereof are calculated. The volume average particle diameter and the number average particle diameter are available from the distribution thus determined. The number of channels used in the measurement is thirteen. The ranges of the channels are from 2.00 μm to less than 2.52 μm, from 2.52 μm to less than 3.17 μm, from 3.17 μm to less than 4.00 μm, from 4.00 μm to less than 5.04 μm, from 5.04 μm to less than 6.35 μm, from 6.35 μm to less than 8.00 μm, from 8.00 μm to less than 10.08 μm, from 10.08 μm to less than 12.70 μm, from 12.70 μm to less than 16.00 μm, from 16.00 μm to less than 20.20 μm, from 20.20 μm to less than 25.40 μm, from 25.40 μm to less than 32.00 μm, from 32.00 μm to less than 40.30 μm. The targets are particles of diameter not smaller than 2.00 μm and smaller than 40.30 μm.

(Evaluation of Inhibition of White Streak Images)

The regulation blades and the toners for the four colors of each of the above-mentioned test samples were amounted in a Ricoh color printer, SP C730 (hereinafter "modified printer"). Using the modified printer, a running test was executed. As the running test, a full-color chart in which page coverage rate (i.e., toner coverage rate in page) of each color was 5% was printed on three sheets of A4 sideways per one job. A 2-by-2 halftone chart was printed for each color on every 1000 sheets. Until the number of output sheets reached 40,000, the earliest timing, among four colors, of occurrence of a vertical white streak on the 2-by-2 halftone images was recorded. Inhibition of white streak images was rated as follows.

Excellent: No white streak occurred.

Good: A white streak occurred when the number of printed sheets was greater than 20,000 and smaller than 40,000.

Poor: A white streak occurred when the number of printed sheets was 20,000 or smaller.

(Evaluation of Image Quality, Resolution in Particular)

The regulation blades and the toners for the four colors of each of the above-mentioned test samples were amounted in a Ricoh color printer, SP C730. Using the modified printer, a landscape image was output. The same landscape image was also output by a comparative printer SP C730, which was not modified. The image output by the modified printer was compared with the image output by the comparative printer. The image quality was subjectively evaluated as follows.

Good: Three of five valuators favorably judged that the image formed by the modified printer is better in resolution than the image formed by the comparative machine.

Poor: Three of the five valuators judged that the image formed by the modified printer is inferior in resolution to the image formed by the comparative machine.

The evaluation results of Experiment 1 are presented in Table 1.

TABLE 1

| | | | Test Sample | | | | | | |
|---|---|---|---|---|---|---|---|---|---|
| | | | 1 | 2 | 3 | 4 | 5 | 6 | 7 |
| Regulation blade | Bend angle (°) | | 20 | 40 | 50 | 90 | 20 | 20 | 20 |
| | Rzjis (μm) | | 0.17 | 0.17 | 0.18 | 0.19 | 0.25 | 0.25 | 0.17 |
| Toner | Softening point (° C.) | | 110 | 110 | 110 | 110 | 112 | 110 | 112 |
| | Dv (μm) | | 6.5 | 6.5 | 6.5 | 6.5 | 8.0 | 6.5 | 8.0 |
| | Surface roughness/ Particle diameter (%) | | 2.6 | 2.6 | 2.8 | 2.9 | 3.1 | 3.8 | 2.1 |
| Evaluation | White streak | Rating | Excellent | Excellent | Good | Good | Good | Poor | Excellent |
| | | White streak occurred on | — | — | 37,000th sheet | 28,000th sheet | 33,000th sheet | 17,000th sheet | — |
| | Resolution | Rating | Good | Good | Good | Good | Poor | Good | Poor |
| | | Number of favorable valuators | 5 | 4 | 5 | 5 | 0 | 5 | 0 |

In Table 1, "ratio of surface roughness to particle diameter" represents the ratio defined as Rzjis/Dv×100, where Rzjis represents the ten-point mean roughness, in the area adjacent to (or including) the downstream end of the regulation nip N, of the opposing face 32*a* of the regulation blade, and Dv represents the volume average particle diameter of toner. For example, in the case of Test sample 1, since the mean roughness Rzjis is 0.17 μm and the volume average particle diameter Dv is 6.5 μm, the ratio of surface roughness to particle diameter is calculated as 0.17/6.5×100=2.6%.

In Table 1, except Test sample 6, inhibition of white streak images is rated as excellent or good. In Test samples 1 through 5 and 7 (except Test sample 5), the ratio of surface roughness to particle diameter is not greater than 3.5, which is smaller compared with the ratio in Test sample 6 (3.8%). Accordingly, the occurrence of white streak is conceivably inhibited when the ratio of surface roughness to particle diameter is not greater than 3.5%. By contrast, when the ratio of surface roughness to particle diameter is greater than 3.5% as in Test sample 6, the occurrence of white streak is not prevented.

When Test samples 5 and 6 are focused, even when the ten-point mean roughness Rzjis is large (0.25 μm in Test samples 5 and 6), white streak images are conceivably inhibited when the ratio of surface roughness to particle diameter is not greater than 3.5%. However, when toner having a small volume average particle diameter is used, the ten-point mean roughness Rzjis should be reduced accordingly. According to the evaluation results of image quality (resolution) in Table 1, use of toner having a volume average particle diameter not greater than 7 μm is preferable to attain desirable image quality (high-resolution images). In such a case, the ten-point mean roughness Rzjis is preferably smaller than or equal to 0.2 μm.

Additionally, when Test samples 1 through 4 are focused, the ten-point mean roughness Rzjis and the ratio of surface roughness to particle diameter are similar among Test samples 1 through 4. Regarding inhibition of white streak images, while the rating is excellent in Test samples 1 and 2, the rating is good in Test samples 3 and 4. Such difference in the rating is conceivably caused by the difference in bend angle of the regulation blade. That is, since the bend angles of Test samples 1 and 2 are relatively small (20 degrees and 40 degrees), Test samples 1 and 2 are better in inhibition of white streak images than Test samples 3 and 4 in which the bend angles are relatively large (50 degrees and 90 degrees). Accordingly, the bend angle of the regulation blade is preferably not greater than 40 degrees.

Table 2 below presents evaluation results of Experiment 2 using Test samples 8 through 11.

TABLE 2

| | | | Test Sample | | | |
|---|---|---|---|---|---|---|
| | | | 8 | 9 | 10 | 11 |
| Regulation blade | Bend angle (°) | | 20 | 20 | 5 | 20 |
| | Rzjis (μm) | | 0.20 | 0.07 | 0.17 | 0.17 |
| Toner | Softening point (° C.) | | 110 | 110 | 110 | 110 |
| | Dv (μm) | | 5.7 | 6.5 | 6.5 | 5.0 |
| | Surface roughness/ Particle diameter (%) | | 3.5 | 1.1 | 2.6 | 3.4 |
| Evaluation | White streak | Rating | Excellent | Poor | Excellent | Poor |
| | | White streak occurred on | — | 18,000th sheet | — | 12,000th sheet |

TABLE 2-continued

| | | Test Sample | | | |
|---|---|---|---|---|---|
| | | 8 | 9 | 10 | 11 |
| Resolution | Rating | Good | Good | Poor | Good |
| | Number of favorable valuators | 5 | 4 | 0 | 5 |

The regulation blades and the toners used in Test samples 8 through 11 have the following characteristics.

(Test Sample 8)

Regulation blade: The regulation blade was subjected to treatment and processing similar to those of Test sample 1 so that the regulation blade were similar to that of Test sample 1 except that the ten-point mean roughness was 0.20 μm.

Toner: Toner having a softening point of 110° C. and a volume average particle diameter of 5.7 μm was used.

(Test Sample 9)

Regulation blade: The regulation blade is similar to that of Test sample 8 except that the ten-point mean roughness is 0.07 μm.

Toner: Toner having a softening point of 110° C. and a volume average particle diameter of 6.5 μm was used.

(Test Sample 10)

Regulation blade: The regulation blade is different from that of Test sample 8 in that the bend angle is 5 degrees and the ten-point mean roughness is 0.17 μm.

Toner: Toner having a softening point of 110° C. and a volume average particle diameter of 6.5 μm was used.

(Test Sample 11)

Regulation blade: The regulation blade is similar to that of Test sample 8 except that the ten-point mean roughness is 0.17 μm.

Toner: Toner having a softening point of 110° C. and a volume average particle diameter of 5.0 μm was used.

It is to be noted that measurements of the ten-point mean roughness of the regulation blade, the softening point of toner, and the volume average particle diameter of toner; and evaluation of white streak inhibition and image quality (resolution) are similar to those described in Experiment 1.

In each test sample presented in Table 2, the ratio of surface roughness to particle diameter is smaller than or equal to 3.5%, but inhibition of white streak images was rated as poor in Test samples 9 and 11.

In Test sample 9, the ten-point mean roughness of the regulation blade is 0.07 μm, which is extremely small compared with other test samples. When the ten-point mean roughness of the regulation blade is extremely small (the surface of the regulation blade is too smooth) as in Test sample 9, the area of contact between the toner and the regulation blade increases, and chance for the toner to adhere to the regulation blade increases. Accordingly, white streak images are likely to occur even when the ratio of surface roughness to particle diameter is not greater than 3.5%. Considering that the ten-point mean roughness of the regulation blade is 0.07 μm in Test sample 9, the ten-point mean roughness of the regulation blade is preferably greater than or equal to 0.08 μm to inhibit white streak images. When the results in Table 2 are combined with those in Table 1, the ten-point mean roughness Rzjis is preferably from 0.08 μm to 0.2 μm. Additionally, considering that the ratio of surface roughness to particle diameter of Test sample 9 is 1.1%, the ratio is preferably greater than or equal to 1.2% to inhibit the occurrence of white streak images. Therefore, the ratio of surface roughness to particle diameter is preferably from 1.2% to 3.5%.

Use of toner smaller in volume average particle diameter is a conceivable cause of the rating "poor" in inhibition of white streak images in Test sample 11. Specifically, even when the softening point is the same, a toner particle whose volume average particle diameter is small has a small thermal capacity and is more likely to melt. Accordingly, such toner easily adheres to the regulation blade. Considering that the volume average particle diameter of toner of Test sample 11 is 5.0 μm, the particle diameter is preferably greater than or equal to 5.1 μm to inhibit the occurrence of white streak images. As described above, when the volume average particle diameter of toner is smaller than or equal to 7 μm, desirable quality (high-resolution) images are obtained. Accordingly, the volume average particle diameter of toner is preferably in a range of from 5.1 μm to 7 μm to inhibit white streak images.

Regarding Test sample 10, although inhibition of white streak was rated as excellent, image quality (resolution) was rated as poor. Such results were conceivably caused as follows. The bend angle in Test sample 10 is 5 degrees and extremely small. Accordingly, the regulating capability of the regulation blade is small and allows an excessive amount of toner to escape the regulation blade, degrading the image quality. Accordingly, the bend angle of the regulation blade is preferably greater than or equal to 6 degrees to suppress degradation of image quality. Considering that the bend angle of the regulation blade is preferably not greater than 40 degrees to inhibit white streak images, the bend angle is preferably from 6 degrees to 40 degrees to attain both of inhibition of white streak images and desirable image quality.

As described above, the occurrence of white streak images can be inhibited when the ratio of surface roughness of the regulation blade 32 to toner particle diameter is smaller than or equal to 3.5%. Specifically, when the ratio defined as Rzjis/Dv×100, in which Rzjis represents the ten-point mean roughness of the portion where toner adhesion starts (i.e., a nip-adjacent portion adjacent to the downstream end of the regulation nip N) in the regulation blade 32 and Dv represents the volume average particle diameter of toner, is set as described above, the toner is inhibited from being caught on the regulation blade 32. The toner being caught on the regulation blade 32 can become the origin of toner adhesion. This configuration can effectively suppress the growth of toner adhesion and accordingly inhibit the occurrence of white streak images.

Further, according to the description above, even in cases where small-diameter toner (e.g., volume average particle diameter Dv is not greater than 7 μm) corresponding to high image quality is used, the occurrence of white streak image is inhibited when the ratio of surface roughness Rzjis to volume average particle diameter Dv of toner is smaller than or equal to 3.5%. In other words, when the surface roughness of the regulation blade 32 is reduced as described above, limiting the rate of small-diameter toner particles is not necessary. Therefore, inhibition of toner adhesion can consist with high image quality (high resolution). Currently, from the viewpoint of energy saving, small-diameter toner having a low softening point (e.g., from 95° C. to 120° C.), which easily melts and adheres to the regulation blade 32, is increasingly used. Even when such toner is used, toner adhesion on the regulation blade 32 is suppressed according to the above-described embodiment.

Further, when toner having a volume average particle diameter of from 1 μm to 7 μm is used, toner adhesion on the regulation blade 32 is better inhibited while securing high image quality. In this case, the ten-point mean roughness Rzjis of the regulation blade 32 in the nip-adjacent portion (adjacent to the downstream end of the regulation nip N) is preferably from 0.08 μm to 0.2 μm and the ratio of surface roughness Rzjis to volume average particle diameter Dv is from 1.2% to 3.5%. Further, when the bend angle θ of the regulation blade 32 is in a range of from 6 degrees to 40 degrees, the occurrence of white streak images can be better inhibited and high image quality can be attained.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A developing device comprising:

a developer bearer disposed facing a latent image bearer, the developer bearer to rotate to supply developer to the latent image bearer; and a developer regulator having an opposing face to oppose the developer bearer and disposed in contact with a surface of the developer bearer in a regulation nip, in which the developer regulator regulates an amount of the developer borne on the surface of the developer bearer, wherein a ratio of a ten-point mean roughness of the developer regulator to a volume average particle diameter of the developer is not greater than 3.5%, the ratio defined as $$Rzjis/Dv\times100,$$

where Rzjis represents the ten-point mean roughness measured in a nip-adjacent portion of the opposing face of the developer regulator, the nip-adjacent portion being adjacent to and downstream from a downstream end of the regulation nip in a rotation direction of the developer bearer, and Dv represents the volume average particle diameter of the developer.

2. The developing device according to claim 1, wherein the nip-adjacent portion extends for 2 mm to a downstream side from the downstream end of the regulation nip in the rotation direction of the developer bearer.

3. The developing device according to claim 2, wherein the ratio defined as Rzjis/Dv×100 is in a range of from 1.2% to 3.5%.

4. The developing device according to claim 1, wherein the ten-point mean roughness (Rzjis) of the developer regulator is not greater than 0.2 μm.

5. The developing device according to claim 4, wherein the ten-point mean roughness (Rzjis) is in a range of from 0.08 μm to 0.2 μm.

6. The developing device according to claim 1, wherein the developer regulator includes a bend on a free end side of the developer regulator, the bend disposed in contact with the surface of the developer bearer, and a bend angle of the bend is not greater than 40 degrees.

7. The developing device according to claim 6, wherein the bend angle of the bend is in a range of from 6 degrees to 40 degrees.

8. The developing device according to claim 1, wherein the volume average particle diameter (Dv) of the developer is not greater than 7 μm.

9. The developing device according to claim 8, wherein the volume average particle diameter (Dv) of the developer is in a range of from 5.1 μm to 7 μm.

10. The developing device according to claim 1, wherein the developer is toner having a softening point in a range of from 95° C. to 120° C.

11. A process unit to be removably mounted in an image forming apparatus, the process unit comprising:

the latent image bearer to bear a latent image; and the developing device according to claim 1, to develop the latent image.

12. An image forming apparatus comprising: the process unit according to claim 11; and a transfer device to transfer the developed image onto a recording medium.

13. An image forming apparatus comprising:

the latent image bearer to bear a latent image; and the developing device according to claim 1, to develop the latent image.

14. The developing device according to claim 1, wherein the developer regulator is made of a metal plate.

15. The developing device according to claim 1, wherein the developer is a nonmagnetic one-component developer that includes a nonmagnetic toner without a carrier.

* * * * *